US009899203B2

(12) United States Patent
Mizutani et al.

(10) Patent No.: US 9,899,203 B2
(45) Date of Patent: Feb. 20, 2018

(54) MASS SPECTROMETRY METHOD AND MASS SPECTROMETER

(71) Applicant: SHIMADZU CORPORATION, Kyoto-shi, Kyoto (JP)

(72) Inventors: Shiro Mizutani, Uji (JP); Shigenobu Nakano, Kyoto (JP)

(73) Assignee: SHIMADZU CORPORATION, Kyoto-shi, Kyoto (JP)

( * ) Notice: Subject to any disclaimer, the term of this patent is extended or adjusted under 35 U.S.C. 154(b) by 0 days.

(21) Appl. No.: 15/300,478

(22) PCT Filed: Mar. 31, 2014

(86) PCT No.: PCT/JP2014/059458
§ 371 (c)(1),
(2) Date: Sep. 29, 2016

(87) PCT Pub. No.: WO2015/151160
PCT Pub. Date: Oct. 8, 2015

(65) Prior Publication Data

US 2017/0125233 A1 May 4, 2017

(51) Int. Cl.
*H01J 49/42* (2006.01)
*H01J 49/00* (2006.01)

(52) U.S. Cl.
CPC ..... *H01J 49/421* (2013.01); *H01J 49/0027* (2013.01)

(58) Field of Classification Search
USPC ..... 250/281, 282
See application file for complete search history.

(56) References Cited

U.S. PATENT DOCUMENTS 8,624,181 B1 * 1/2014 Newton ..... H01J 49/40 250/281
2001/0030284 A1 * 10/2001 Dresch ..... H01J 49/401 250/287

(Continued)

FOREIGN PATENT DOCUMENTS

CA 2 669 328 A1 5/2008
CN 101611466 A 12/2009

(Continued)

OTHER PUBLICATIONS

Written Opinion for PCT/JP2014/059458 dated May 13, 2014. [PCT/ISA/237].

(Continued)

*Primary Examiner* — Kiet T Nguyen
(74) *Attorney, Agent, or Firm* — Sughrue Mion, PLLC

(57) ABSTRACT

The present invention is a mass spectrometer (1) for sequentially performing a measurement for a plurality of target ions, characterized by a storage section (41) for holding ion time-of-flight information concerning the time required for each of target ions to fly through each of the sections constituting the mass spectrometer, and a voltage controller (42) for changing, based on the ion time-of-flight information, the voltage applied to each of those sections to a voltage suited for each target ion, with a time lag corresponding to the difference in the timing of the arrival of the target ion at the section concerned.

8 Claims, 7 Drawing Sheets

(56) References Cited

U.S. PATENT DOCUMENTS

| | | | | |
|---|---|---|---|---|
| 2007/0164213 | A1* | 7/2007 | Javahery | H01J 49/066 250/292 |
| 2008/0073513 | A1* | 3/2008 | Kikuma | H01J 49/40 250/290 |
| 2009/0127453 | A1* | 5/2009 | Ding | H01J 49/0072 250/282 |
| 2010/0059673 | A1 | 3/2010 | Makarov et al. | |
| 2011/0062323 | A1* | 3/2011 | Brown | H01J 49/0072 250/282 |
| 2011/0174967 | A1 | 7/2011 | Kou | |

FOREIGN PATENT DOCUMENTS

| | | | |
|---|---|---|---|
| DE | 11 2007 002 747 | T5 | 10/2009 |
| EP | 2 346 065 | A1 | 7/2011 |
| GB | 2 455 692 | A | 6/2009 |
| JP | 1-195647 | A | 8/1989 |
| JP | 2009-266445 | A | 11/2009 |
| JP | 2010-509743 | A | 3/2010 |
| JP | 2011-146287 | A | 7/2011 |
| JP | 5201220 | B2 | 6/2013 |
| WO | 2008/059246 | A2 | 5/2008 |
| WO | 2010/089798 | A1 | 8/2010 |

OTHER PUBLICATIONS

International Search Report of PCT/JP2014/059458, dated May 13, 2014. [PCT/ISA/210].

Communication dated Jun. 6, 2017 issue by the Japanese Patent Office in counterpart application No. 2016-511187.

* cited by examiner

T
δt
VOLTAGE FOR POSITIVE ION (+HV)

VOLTAGE RESPONSE IN IONIZER
NEGATIVE VOLTAGE (-HV)
VOLTAGE FOR NEGATIVE ION (-HV)
t1

ION RESPONSE AT VACUUM INTRODUCTION SECTION
POSITIVE ION
NEGATIVE ION
VOLTAGE FOR POSITIVE ION (+HV)

VOLTAGE RESPONSE IN OTHER SECTIONS
VOLTAGE FOR NEGATIVE ION (-HV)
T-(δt+t1)
NEGATIVE ION

POSITIVE ION
ION RESPONSE IN ION DETECTOR
TIME t

VOLTAGE RESPONSE IN IONIZER

ION RESPONSE AT VACUUM INTRODUCTION SECTION

VOLTAGE RESPONSE IN OTHER SECTIONS

ION RESPONSE IN ION DETECTOR
T
δt
VOLTAGE FOR POSITIVE ION (+HV)
NEGATIVE VOLTAGE (-HV)
VOLTAGE FOR NEGATIVE ION (-HV)
t1
POSITIVE ION
NEGATIVE ION
t1
T
VOLTAGE FOR POSITIVE ION (+HV)
VOLTAGE FOR NEGATIVE ION (-HV)
T- δt
NEGATIVE ION
POSITIVE ION
TIME t

T
δt
V1(m/z=1500)

VOLTAGE RESPONSE
IN Q1 SYSTEM
V2(m/z=500)
V2(m/z=500)
t2

ION A (m/z=1500)
ION B (m/z=500)
ION RESPONSE AT
EXIT OF COLLISION CELL
V1'(m/z=700)

VOLTAGE RESPONSE
IN Q3 SYSTEM
V2'(m/z=200)
V2'(m/z=200)

T-(δt+t2)
ION b (m/z=200)
ION RESPONSE
IN ION DETECTOR
ION b
(m/z=200)
ION a (m/z=700)
TIME t

T
δt
V1(m/z=1500)

VOLTAGE RESPONSE
IN Q1 SYSTEM
V2(m/z=500)
V2(m/z=500)
t2

ION B (m/z=500)
ION A (m/z=1500)
ION B (m/z=500)
ION RESPONSE AT
EXIT OF COLLISION CELL
t2
T

V1'(m/z=700)
VOLTAGE RESPONSE
IN Q3 SYSTEM
V2'(m/z=200)
V2'(m/z=200)

T- δt
ION b (m/z=200)
ION RESPONSE
IN ION DETECTOR
ION b (m/z=200)
ION a (m/z=700)
TIME t

EMBODIMENT
Fig. 6B
CONVENTIONAL
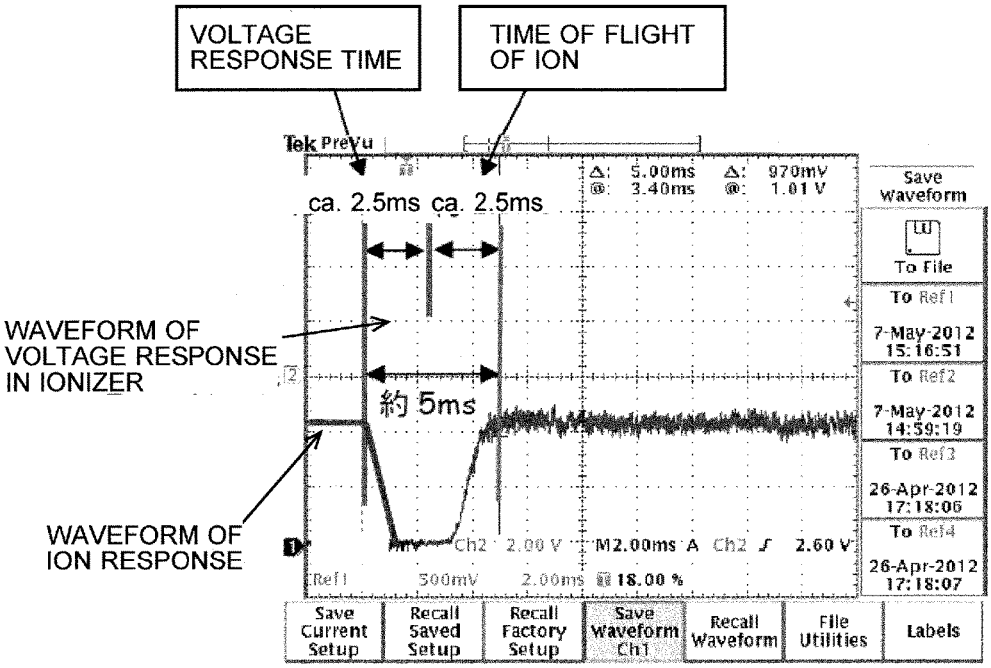

MASS SPECTROMETRY METHOD AND MASS SPECTROMETER

CROSS REFERENCE TO RELATED APPLICATIONS

This application is a National Stage of International Application No. PCT/JP2014/059458 filed Mar. 31, 2014, the contents of all of which are incorporated herein by reference in their entirety.

TECHNICAL FIELD

The present invention relates to a mass spectrometry method and mass spectrometer for sequentially performing a measurement for a plurality of ions having different polarities and/or mass-to-charge ratios.

BACKGROUND ART

For a qualitative or quantitative determination of various components contained in a sample, a chromatograph mass spectrometer is widely used, which includes a chromatograph, such as a gas chromatograph (GC) or liquid chromatograph (LC), combined with a mass analyzer, such as a quadrupole mass analyzer (for example, see Patent Literature 1).

In the case where a chromatograph mass spectrometer is used for checking a plurality of residual agricultural chemicals or other impurities contained in a sample (such as food), one or more ions ("target ions") are set for each of the residual agricultural chemicals to be checked ("target components"), and a selected ion monitoring (SIM) measurement for sequentially and repeatedly detecting those ions is performed to obtain a mass chromatogram for each target component. In the case of a triple quadrupole mass spectrometer or similar type of mass analyzer including front and rear mass filters with a collision cell sandwiched in between, one or more combinations of the precursor ion and product ion are set for each of the target components, and a multiple reaction monitoring (MRM) measurement for sequentially and repeatedly detecting those combinations of the ions is performed to obtain a mass chromatogram for each target component.

In the aforementioned measurement, predetermined voltages which are suited for the detection of the first target ion are initially applied to the relevant sections of the mass spectrometer (the ionizer, ion optical system, mass filter, detector, etc.), and the first target ion is detected for a specific period of time. Subsequently, the voltages applied to those sections are changed to the voltages which are suited for the detection of the second target ion, and the second target ion is detected for a specific period of time. In this manner, all target ions are sequentially subjected to the measurement, and such a cycle of measurements is repeatedly performed to acquire a series of detection signals for each target ion. From the detection signals acquired for each target ion, a mass chromatogram corresponding to the target component is obtained.

CITATION LIST

Patent Literature

Patent Literature 1: JP 5201220 B

SUMMARY OF INVENTION

Technical Problem

When the detection target is switched from the first target ion to the second one, the voltages applied to the relevant sections of the mass spectrometer are changed to the voltages suited for the second target ion. When the cluster of ions with various mass-to-charge ratios generated in the ionizer are made to fly into the subsequent stages of the apparatus and arrive at a mass separator, the ion having a mass-to-charge ratio corresponding to the second target ion is separated from the ion cluster. After passing through the mass separator, the second target ion further flies into the subsequent stages of the apparatus and ultimately reaches the detector. At the point in time where the voltages applied to the relevant sections of the mass spectrometer have been changed, the second target ion exists in a space around the ionizer or vacuum introduction section, and not in the detector. The second target ion generated in the ionizer cannot be detected until the generated ion reaches the detector after sequentially passing through the ion optical system, mass filter and other relevant sections of the mass spectrometer. In other words, a "no-detection period" for the ion (dead time) occurs from the point in time where the voltages applied to the relevant sections of the mass spectrometer are changed until the generated target ion reaches the detector.

The problem to be solved by the present invention is to reduce the no-detection period for the target ion and thereby improve the efficiency of the mass spectrometry in a mass spectrometer for sequentially detecting a plurality of kinds of target ions having different polarities and/or mass-to-charge ratios.

Solution to Problem

The present invention developed for solving the previously described problem is a mass spectrometry method for sequentially performing a measurement for a plurality of target ions using a mass spectrometer, the method including:

changing a voltage applied to each section constituting the mass spectrometer, from a voltage suited for the measurement of an ion subjected to the measurement before the target ion concerned, to a voltage suited for the measurement of the target ion concerned, at a timing corresponding to the time required for each of the target ions to fly through that section.

The mass spectrometer according to the present invention developed for solving the previously described problem is a mass spectrometer for sequentially performing a measurement for a plurality of target ions, including:

a) a voltage output section for generating a voltage for each section constituting the mass spectrometer; and b) a controller for controlling the voltage output section so as to change the voltage applied to each section constituting the mass spectrometer, from a voltage suited for the measurement of an ion subjected to the measurement before the target ion concerned, to a voltage suited for the measurement of the target ion concerned, at a timing corresponding to the time required for each of target ions to fly through that section.

For example, the above-mentioned time can be determined based on the result of a preliminary experiment performed using a standard sample which produces an ion having a known polarity and known mass-to-charge ratio.

For example, the mass spectrometer according to the present invention operates as follows: After a predetermined voltage is applied to an ionizer located in an upstream area in the mass spectrometer, when a measurement target ion generated in the ionizer sequentially arrives at each of the relevant sections (e.g. an ion optical system, mass filter and detector), the voltage applied to each of these sections is changed to a voltage suited for the measurement target ion at a timing corresponding to the arrival of the ion. By this operation, the previously described no-detection period for the target ion is reduced, % hereby the efficiency of the analysis is improved.

Advantageous Effects of the Invention

With the mass spectrometry method and mass spectrometer according to the present invention, it is possible to reduce the no-detection period for the target ion and thereby improve the efficiency of the mass spectrometry in a mass spectrometer for sequentially detecting a plurality of kinds of target ions having different polarities and/or mass-to-charge ratios.

As the number of measurement target ions increases, the time required for one cycle of measurements becomes longer, and the measurement interval for each individual target ion also becomes longer. On the other hand, a longer no-detection period for the target ion means a decrease in the number of detection signals (data points) for the target ion that can be acquired during the elution of the target component from the column. In this situation, the mass chromatogram peak must be constructed from an insufficient number of data points, and it is difficult to correctly reproduce the true shape of the peak. In such a measurement, improving the efficiency of the analysis is particularly required, and therefore, the mass spectrometry method and mass spectrometer according to the present invention can be suitably used.

BRIEF DESCRIPTION OF DRAWINGS

FIGS. 6A and 6B show a result in which the no-detection period for the ion was reduced in the mass spectrometer in the present embodiment.

DESCRIPTION OF EMBODIMENTS

A tandem quadrupole type mass spectrometer 1, which is one embodiment of the mass spectrometer according to the present invention, is hereinafter described with reference to the drawings.

Figure 1:
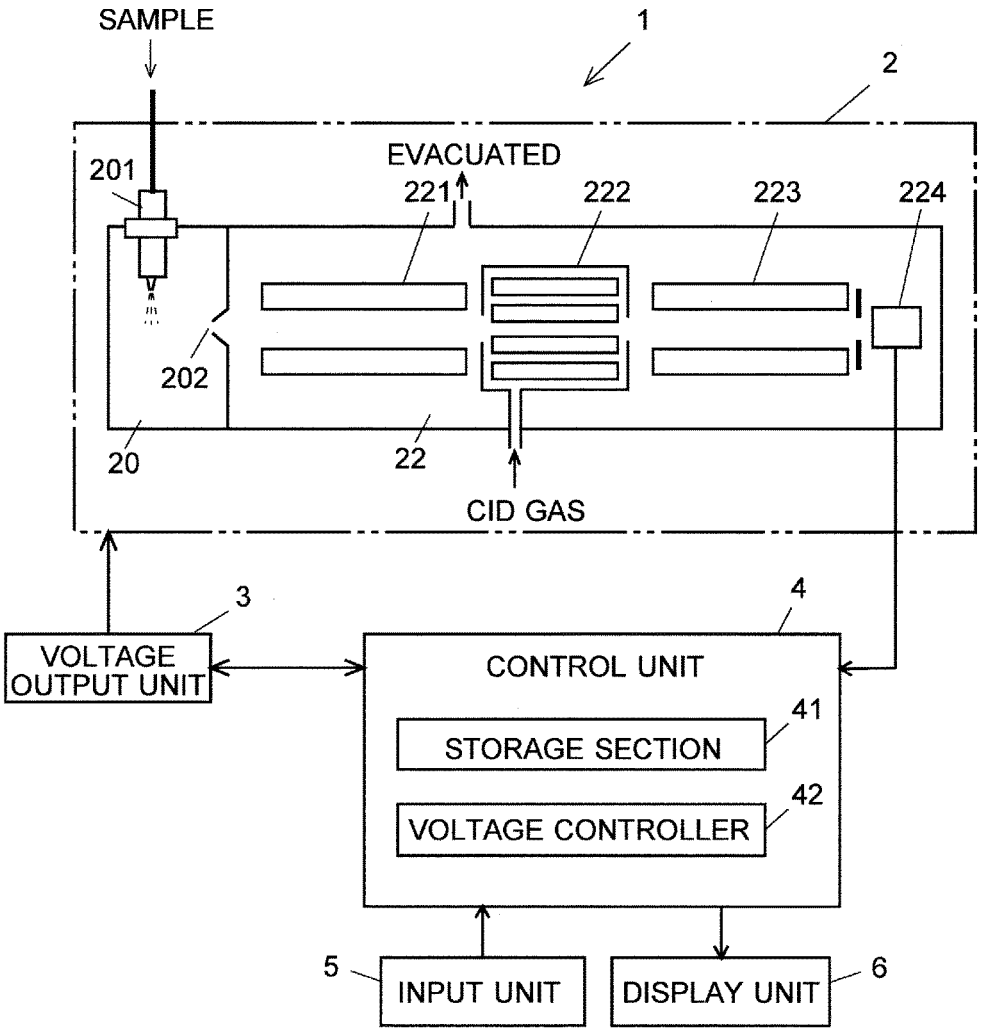
FIG. 1 is a configuration diagram of the main components of one embodiment of the mass spectrometer according to the present invention.

FIG. 1 is a configuration diagram of the main components of the mass spectrometer 1 of the present embodiment. This mass spectrometer 1 includes a mass spectrometry unit 2, voltage output unit 3 and control unit 4.

The mass spectrometry unit 2 includes an ionization chamber 20 maintained at approximately atmospheric pressure and an analysis chamber 22 evacuated with a vacuum pump (not shown). The ionization chamber 20 and the analysis chamber 22 are separated from each other by a skimmer 202 having a small hole at its apex.

The mass spectrometer 1 of the present embodiment includes, as the ionizer, an electrospray ionization (ESI) probe 201 into which a liquid sample is introduced. The ionizer can be appropriately replaced with a different type of ionizer, such as an electron ionization (EI) or atmospheric pressure chemical ionization (APCI) source, according to the form (liquid or gas) and/or properties (e.g. the polarity of the compound) of the sample.

The analysis chamber 22 contains a front quadrupole mass filter (Q1) 221 which separates ions according to their mass-to-charge ratios and a rear quadrupole mass filter (Q3) 223 which also separates ions according to their mass-to-charge ratios, with a collision cell 222 containing a multipole ion guide (q2) placed in between, as well as an ion detector 224.

The voltage output unit 3 applies predetermined voltages to the ESI probe 201, front quadrupole mass filter 221, ion guide in the collision cell 222, rear quadrupole mass filter 223, and ion detector 224, respectively, according to the control signals from a voltage controller 42, which will be described later. Details of the application of those voltages will be described later.

In the mass spectrometry unit 2, a liquid sample which has reached the ESI probe 201 to which a voltage is applied from the voltage output unit 3 is sprayed from the tip of the ESI probe 201 in the form of electrically charged droplets and turns into ions. The generated ions fly within the ionization chamber 20 and pass through the skimmer 202 into the analysis chamber 22, where the ions are introduced into the space extending along the longitudinal axis of the front quadrupole mass filter 221.

The mass spectrometry unit 2 of the present embodiment is capable of both SIM and MRM measurements.

In the SIM measurement, the front and rear quadrupole mass filters 221 and 223 are operated so that one mass filter allows the passage of an ion having a specific mass-to-charge ratio, while the other allows the passage of all ions with any mass-to-charge ratios. The ions which have passed through both mass filters are detected by the ion detector 224. For example, the ion detector 224 is a pulse-counting detector, which generates pulse signals whose number corresponds to the number of incident ions. Those signals are sent to the control unit 4 as detection signals.

In the MRM measurement, a precursor ion having a specific mass-to-charge ratio is allowed to pass through the front quadrupole mass filter 221. This precursor ion is made to collide with CID gas in the collision cell 222, whereby the ion is fragmented into various product ions. Among these ions, only a product ion having a specific mass-to-charge ratio is allowed to pass through the rear quadrupole mass filter 223 and be detected by the ion detector 224.

The control unit 4 has a storage section 41 in which the ion time-of-flight information is stored. It also has a voltage controller 42 as its functional block. The ion time-of-flight information is a piece of information concerning the time required for an ion to fly through the relevant sections of the mass spectrometry unit 2 from the ionizer 201 to the ion detector 224. This information is prepared by a preliminary measurement using a standard sample which has a known polarity and known mass-to-charge ratio, and is stored in the storage section 41 beforehand. The control unit 4 is composed of a CPU board, digital board, analog board and other elements. An input unit 5 and display unit 6 are connected to this unit.

The mass spectrometer 1 of the present embodiment is characterized by the voltage controller 42 which sends control signals to the voltage output unit 3 for applying voltages to the relevant sections of the apparatus, i.e. the ESI probe 201 (ionizer), front quadrupole mass filter 221, ion guide in the collision cell 222, rear quadrupole mass filter 223 and ion detector 224. Accordingly, this aspect of the apparatus will be hereinafter described in detail. Although the following description is concerned with an MRM measurement, the same discussion also holds true for the SIM measurement.

When a command to initiate the MRM measurement is issued by a user, the voltage controller 42 refers to the ion time-of-flight information stored in the storage section 41 for a record which matches with the polarities and mass-to-charge ratios of the precursor ion and product ion previously set as the target MRM transition for the measurement, and reads the time required for those ions to fly through each relevant section of the apparatus ("time of flight"). Based on this time of flight, the offset time for the application of the voltage to each relevant section of the apparatus is determined, with the point in time of the voltage application to the ESI probe 201 (ionizer) as the reference point. After the MRM measurement is initiated, when the measurement target needs to be changed to a different combination of the ions, the voltage applied to each relevant section constituting the mass spectrometer is changed to a voltage suited for that combination of the ions with a time lag corresponding to the aforementioned offset time.

Let t1 denote the time required for the target ion to fly from the ESI probe 201 (ionizer) to the vacuum introduction section (the entrance of the front quadrupole mass filter 221), t3 to denote the time required for the ion to fly from the entrance of the front quadrupole mass filter 221 to the entrance of the collision cell 222, t2 to denote the time required for the ion to fly from the entrance of the collision cell 222 to the entrance of the rear quadrupole mass filter 223, and t4 to denote the time required for the ion to fly from the entrance of the rear quadrupole mass filter 223 to the ion detector 224.

With the timing (point in time) to change the voltage applied to the ESI probe 201 (ionizer) defined as t=−0, the voltage controller 42 changes the voltages applied to the other sections at the following points in time:

Front quadrupole mass filter 221: t1

Ion guide in collision cell 222: t1+t3

Rear quadrupole mass filter 223: t1+t2+t3

Ion detector 224: t1+t2+t3+t4

The reason for shifting the timing to apply the voltage to each relevant section of the apparatus in the previously described manner is hereinafter described using two examples in comparison with the case of a conventional mass spectrometer. In the following description, the apostrophe (') is attached to the numerals denoting the components of the conventional mass spectrometer in order to distinguish between the components of the mass spectrometer according to the present invention and those of the conventional mass spectrometer.

The first example is the case where one positive ion and one negative ion designated as the target ions are alternately subjected to the measurement, with the measurement time T assigned to each ion. For ease of explanation, only t1, i.e. the time required for the generated ion to fly from the ESI probe 201 (ionizer) to the vacuum introduction section (the entrance of the front quadrupole mass filter 221), is considered. The period of time required for the ion to fly from the vacuum introduction section to the ion detector 224 (t2+t3+t4) are assumed to be zero.

FIGS. 2A-2D are diagrams illustrating the voltage application in a conventional mass spectrometer 1', while FIGS. 3A-3D are diagrams illustrating the voltage application in the mass spectrometer 1 of the present embodiment.

Figures 2A, 2B, 2C, 2D:
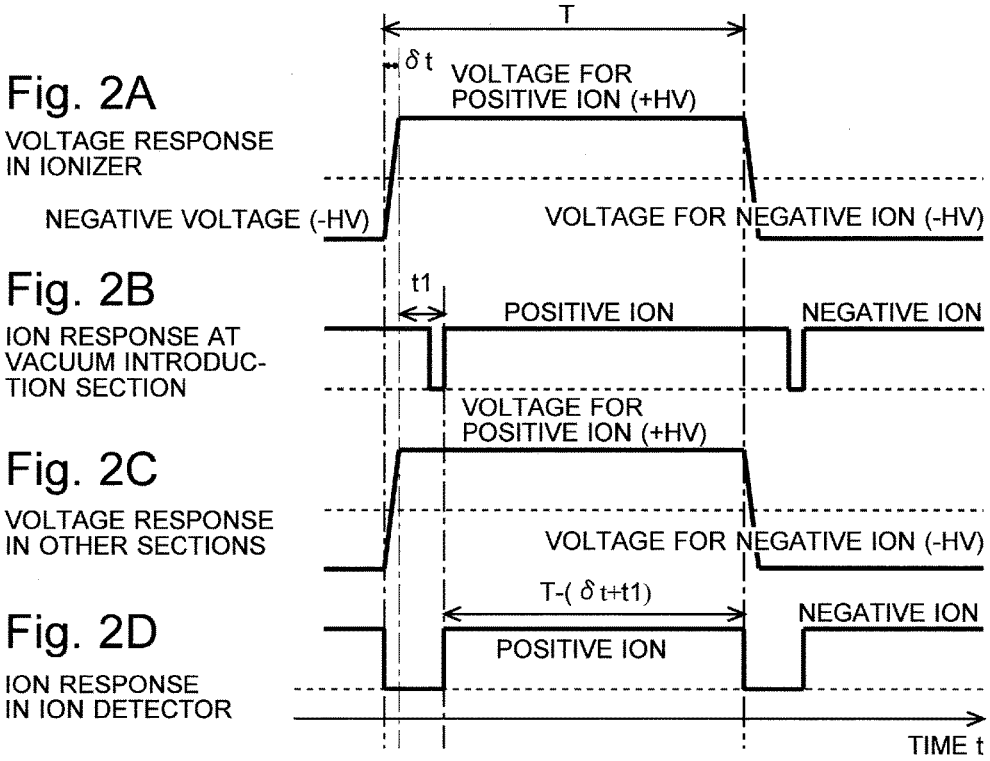
FIGS. 2A-2D are a set of diagrams illustrating the voltage application in a conventional mass spectrometer.

In the conventional mass spectrometer 1', when the measurement target ion is changed from negative to positive ions (or from positive to negative ions), the voltage controller 42' sends a control signal to the voltage output unit 3' so as to simultaneously change the voltages applied to the relevant sections constituting the apparatus (FIGS. 2A and 2C). With the timing to send the control signal from the voltage controller 42' to the voltage output unit 3' defined as t=0, the new voltages are applied from the voltage output unit 3' to the relevant sections after the response time δt required for the switching of the output voltages in the voltage output unit 3' has elapsed.

In the ionizer 201', after the elapse of time δt, the new voltage is applied and positive ions begin to be generated (FIG. 2B). It takes time t1 for the generated positive ions to fly to the vacuum introduction section. As already noted, the time of flight from the vacuum introduction section to the ion detector 224' is not considered in the present example. Accordingly, the positive ions begin to be detected at the same point in time as a time when the generated positive ions reach the vacuum introduction section in the ion detector 224'. When time T has elapsed, the measurement for the positive ions is discontinued, and the voltages applied to the relevant sections of the apparatus are changed to the voltages suited for the measurement of the negative ions.

In this case, the positive ions are detected in the ion detector 224' within a period of time from t−δt+t1 to t=T (FIG. 2D). In other words, a no-detection period for the ion having a length of δt+t1 occurs within the measurement time T assigned for the positive ions.

Figures 3A, 3B, 3C, 3D:
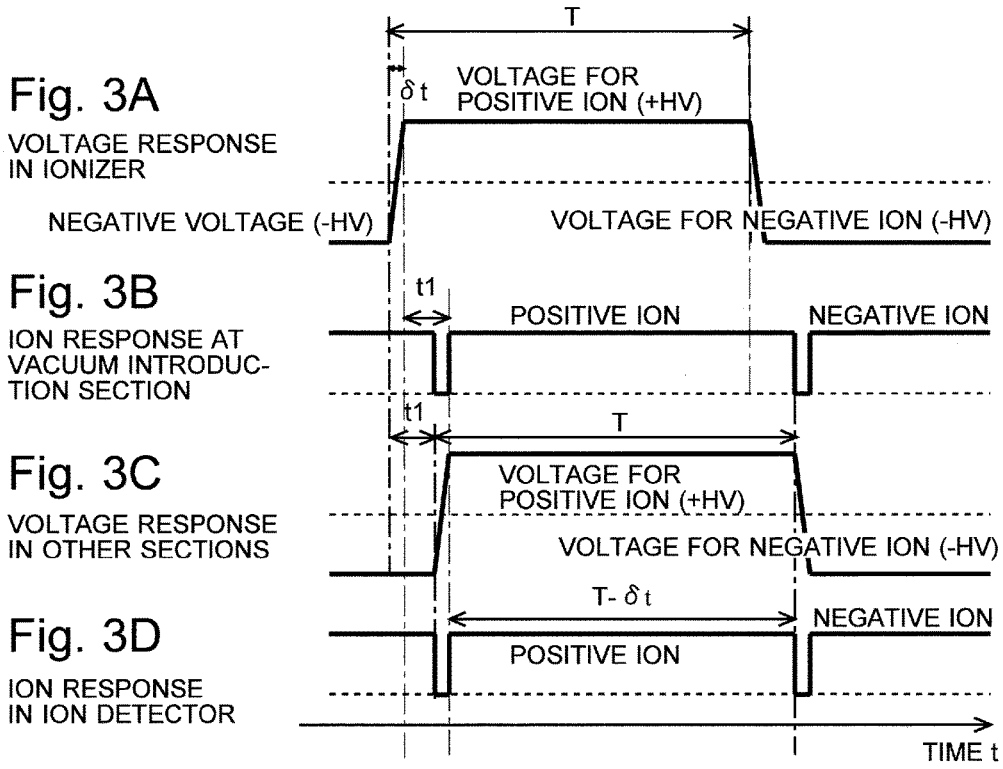
FIGS. 3A-3D are a set of diagrams illustrating the voltage application in a mass spectrometer of the present embodiment.

By comparison, in the mass spectrometer 1 of the present embodiment, the time required for the ions to fly from the ionizer 201 to the vacuum introduction section is taken into account. That is to say, after the voltage applied to the ionizer 201 is changed, a period of time t1 is made to elapse before the voltages applied to the other relevant sections are changed (FIGS. 3A and 3C). This means that the ionizer 201 has a period of time from t=0 to t=T assigned for the measurement of the positive ions, while the other sections have a period of time from t=t1 to t=T+t1 assigned for the measurement of the positive ions.

When such a time lag is set for the timing to change the voltage applied to each relevant section of the apparatus, the period of time where the positive ion is detected in the ion detector 224 will be from t=δt+t1 to t=t1+T (FIGS. 3B and 3D). That is to say, the no-detection period for the ion within the measurement time T assigned for the positive ions is reduced to only the voltage response time δt. In other words, the no-detection period t1 for the ion due to the time required for the ion to fly through the inside of the apparatus is eliminated.

The following example is the case where the following two kinds of MRM transitions are alternately subjected to the measurement, with measurement time T assigned to each transition.

Transition 1: precursor ion "A" (m/z=1500) and product ion "a" (m/z=700)

Transition 2: precursor ion "B" (m/z=500) and product ion "b" (m/z=200)

Once again, for ease of explanation, only t2, i.e. the time of flight required for the ion to fly through the collision cell, is considered. The period of time required for the ions to pass through the other relevant sections (t1+t3+t4) is not taken into account. FIGS. 4A-4D are diagrams illustrating the voltage application in the conventional mass spectrometer 1', while FIGS. 5A-5D are diagrams illustrating the voltage application in the mass spectrometer 1 of the present embodiment.

Figures 4A, 4B, 4C, 4D:
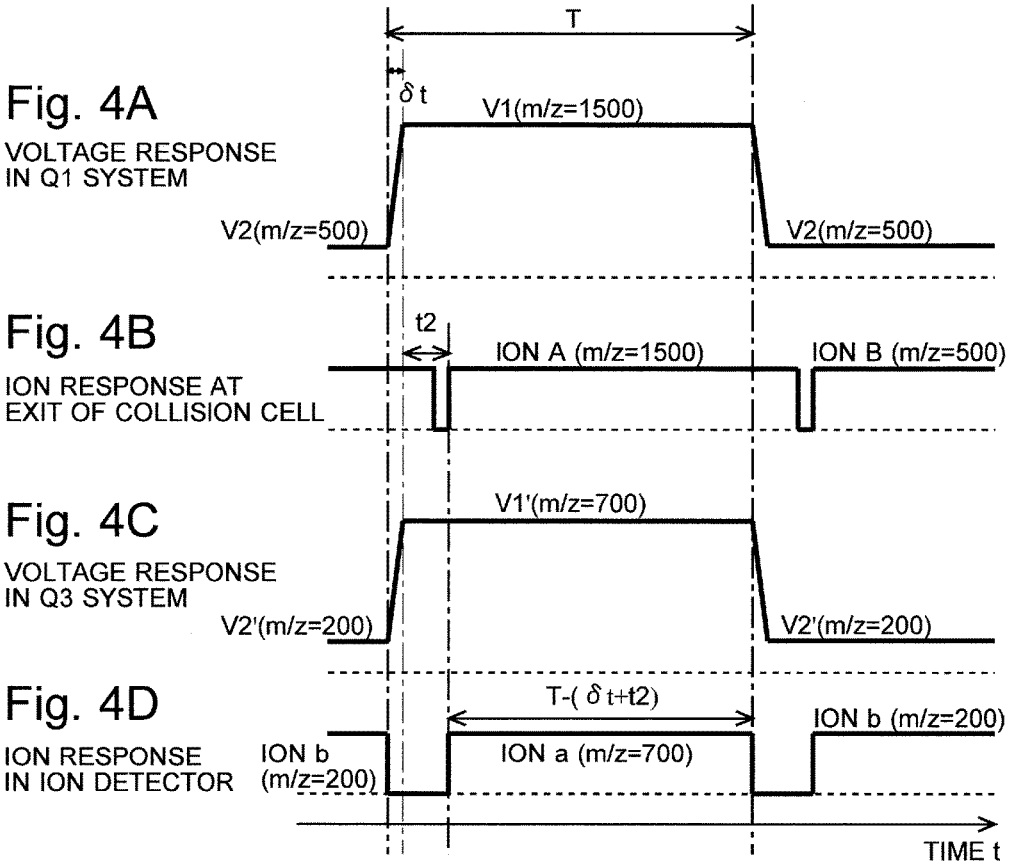
FIGS. 4A-4D are another set of diagrams illustrating the voltage application in a conventional mass spectrometer.

As described earlier, in the conventional mass spectrometer 1', when the measurement target is changed from Transition 2 to Transition 1, the voltage controller 42' sends a control signal to the voltage output unit 3' so as to simultaneously change the voltages applied to the relevant sections constituting the apparatus (FIGS. 4A and 4C). With the timing to send the control signal from the voltage controller 42' to the voltage output unit 3' defined as t=0, the product ion "a" of Transition 1 is detected in the ion detector 224' within a period of time from t=δt+t2 to t=T (FIGS. 4B and 4D). In other words, a no-detection period for the ion with a length of δt+t2 occurs within the measurement time T assigned for Transition 1.

Figures 5A, 5B, 5C, 5D:
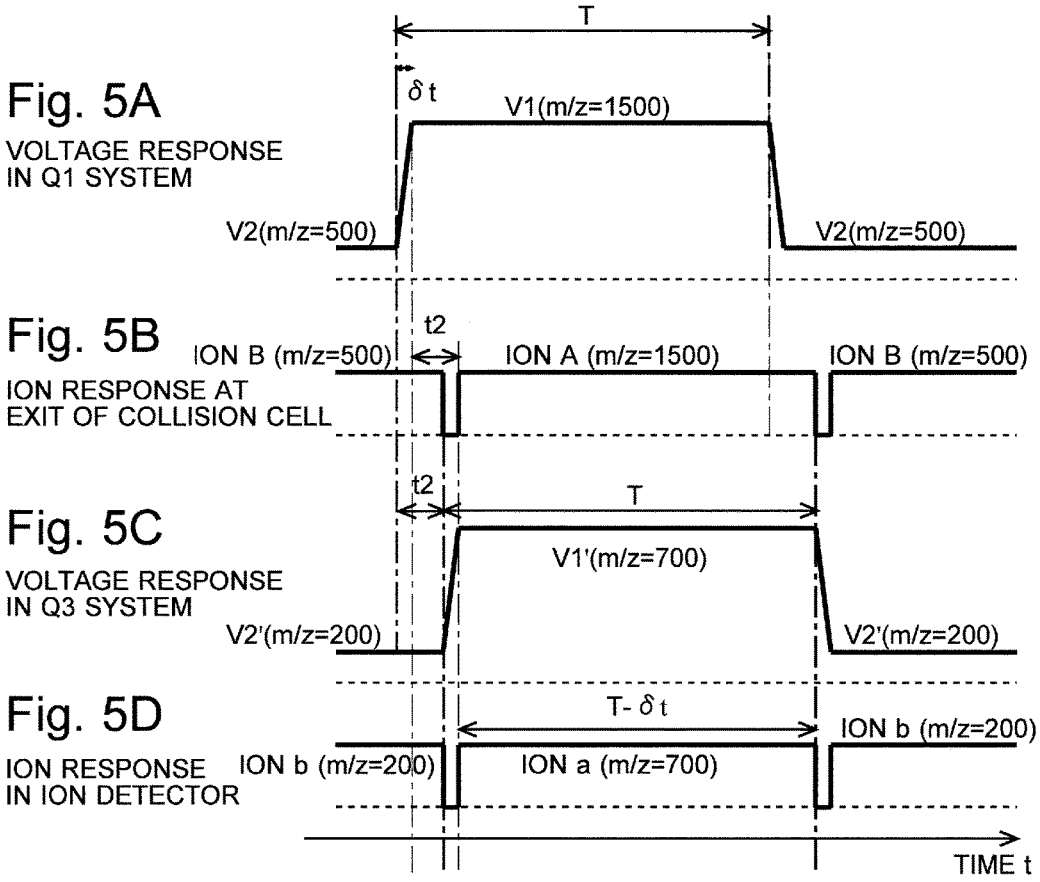
FIGS. 5A-5D are another set of diagrams illustrating the voltage application in a mass spectrometer of the present embodiment.

By comparison, the mass spectrometer 1 of the present embodiment sets a time lag taking into account the time t2 required for product ion "a" generated by the fragmentation of precursor ion "A" in the collision cell 222 to pass through the same cell. That is to say, after the voltage applied to the Q1 system (i.e. the Q1 (221) and previous sections) is changed from V2 to V1, a period of time t2 is made to elapse before the voltage applied to the Q3 system (i.e. the Q3 (223) and subsequent sections) is changed from V2' to V1' (FIGS. 5A and 5C). This means that the Q1 system has a period of time from t=0 to t=T assigned for the measurement of Transition 1, while the Q3 system has a period of time from t=t2 to t=T+t2 assigned for the measurement of Transition 1.

When such a time lag is set for the timing to change the voltage applied to each relevant section of the apparatus, the period of time where the product ion "a" is detected in the ion detector 224 will be from t=δt+t2 to t=t2+T (FIGS. 5B and 5D). That is to say, the no-detection period for the ion within the measurement time T assigned for Transition 1 is reduced to only the voltage response time δt. In other words, the no-detection period t2 for the ion due to the time required for fragmenting the precursor ion "A" into the product ion "a" in the collision cell 222 and for making this ion fly through the collision cell 222 is eliminated.

Figure 6A:
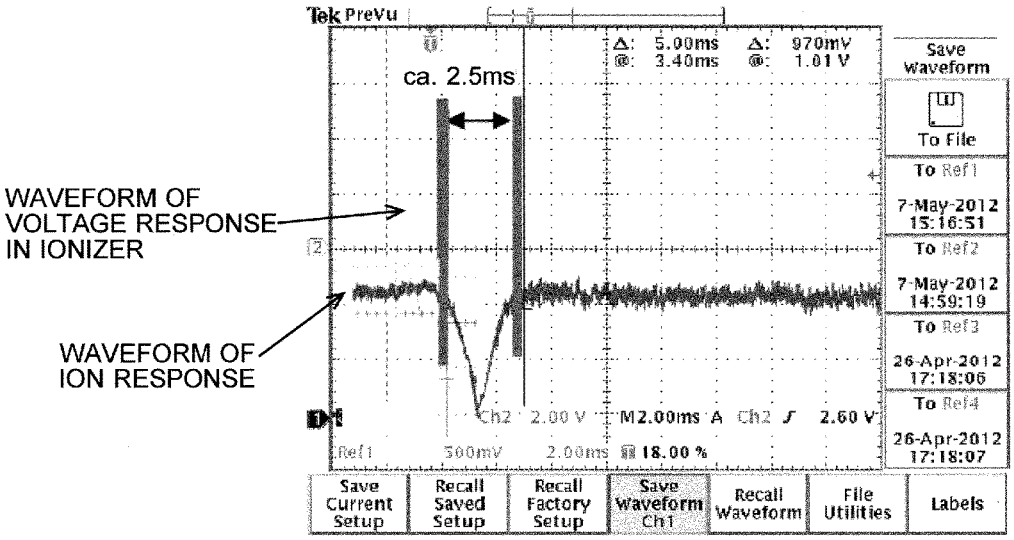

FIG. 6A shows a result in which the no-detection period for the ion was reduced in the mass spectrometer in the present embodiment. In the case of the conventional mass spectrometer 1', as shown in FIG. 6B, there is a no-detection period for the ion with a length of 5 ms, which is the sum of the voltage response time (2.5 ms) and the time of flight of the ion (2.5 ms). By comparison, in the mass spectrometer 1 of the present invention, the no-detection period is reduced to only the voltage response time, 2.5 ms.

In the aforementioned ion time-of-flight information, the same time of flight may be set for all ions regardless of the mass-to-charge ratios of the ions. However, it is preferable to set an appropriate time of flight for each mass-to-charge ratio of the ion. This configuration enables an even more accurate reduction of the no-detection period for the ion due to the time required for the ion to fly through the apparatus.

Figure 7:
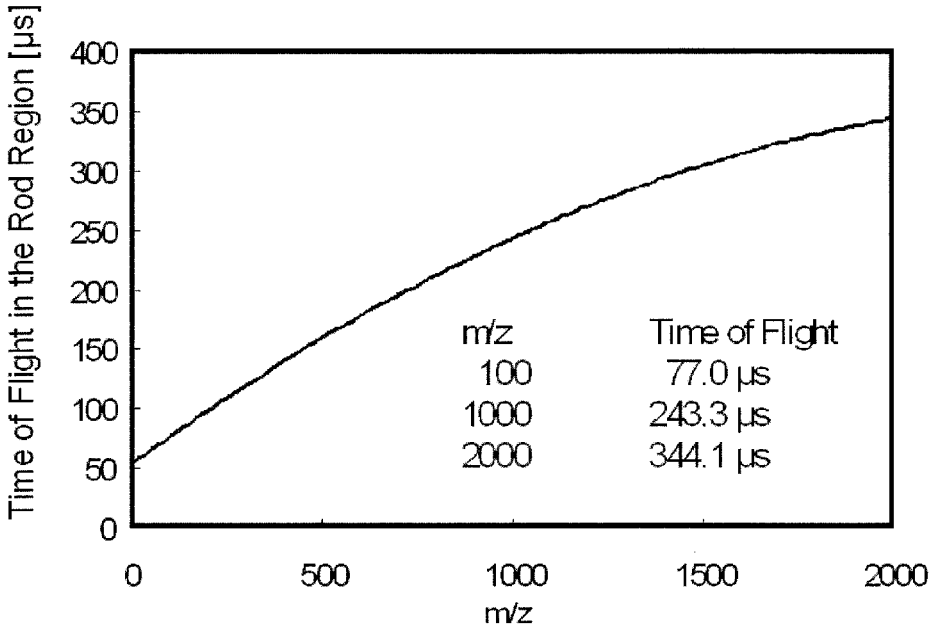
FIG. 7 is a graph showing the relationship between the mass-to-charge ratio and time of flight of ions.

The present inventors have investigated the period of time required for various ions with different mass-to-charge ratios to pass through a quadrupole filter. The result was as shown in FIG. 7, which demonstrates that the time of flight increases with an increase in the mass-to-charge ratio of the ion. By using such information, the ion time-of-flight information can be prepared in the form of a set of information in which the mass-to-charge ratio of the ion is associated with the time of flight of the ion.

The previous embodiment is a mere example and can be appropriately changed within the spirit of the present invention.

The previous embodiment was concerned with the case of shifting the timings to apply the voltages to the ionizer 201, front quadrupole mass filter 221, rear quadrupole mass filter 223 and ion detector 224 of the mass spectrometer 1. It is possible to shift only the timing of changing the voltage applied to some of those sections. A possible configuration is to consider only the time of flight in a section in which it takes a particular length of time for the ion to fly through, such as the time of flight from the ionizer 201 to the vacuum introduction section or the time of flight within the collision cell 222.

Although the previous embodiment was a tandem quadrupole mass spectrometer, the previously described configurations can be similarly applied in a mass spectrometer which has a single quadrupole mass filter as well as a mass spectrometer which includes an ion trap for fragmenting a precursor ion a plurality of times and is capable of an $MS^n$ analysis.

REFERENCE SIGNS LIST

1 . . . Mass Spectrometer
2 . . . Mass Spectrometry Unit
  20 . . . Ionization Chamber
    201 . . . ESI Probe
    202 . . . Skimmer
  22 . . . Analysis Chamber
    221 . . . Front Quadrupole Mass Filter
    222 . . . Collision Cell
    223 . . . Rear Quadrupole Mass Filter
    224 . . . Ion Detector
3 . . . Voltage Output Unit
4 . . . Control Unit
  41 . . . Storage Section
  42 . . . Voltage Controller
5 . . . Input Unit
6 . . . Display Unit

The invention claimed is:

1. A mass spectrometry method for sequentially performing a measurement for each of a plurality of target ions using a mass spectrometer, the method comprising:

changing a voltage applied to each section constituting the mass spectrometer, from a voltage suited for a measurement of an ion subjected to a measurement before a measurement of a target ion concerned, to a voltage suited for the measurement of the target ion concerned, at a timing determined based on a time required for each of the target ions to fly through that section.

2. The mass spectrometry method according to claim 1, wherein the time of flight is associated with a mass-to-charge ratio of an ion.

3. The mass spectrometry method according to claim 2, wherein at least one kind of positive ion and at least one kind of negative ion are included in the plurality of target ions.

4. The mass spectrometry method according to claim 1, wherein at least one kind of positive ion and at least one kind of negative ion are included in the plurality of target ions.

5. A mass spectrometer for sequentially performing a measurement for each of a plurality of target ions, comprising:

a) a voltage output section for generating a voltage for each section constituting the mass spectrometer; and b) a controller for controlling the voltage output section so as to change the voltage applied to each section constituting the mass spectrometer, from a voltage suited for a measurement of an ion subjected to a measurement before a measurement of a target ion concerned, to a voltage suited for the measurement of the target ion concerned, at a timing determined based on a time required for each of the target ions to fly through that section.

6. The mass spectrometer according to claim 5, comprising:

a storage section in which information concerning the time of flight is stored as information associating a mass-to-charge ratio of an ion with a time of flight of the ion.

7. The mass spectrometer according to claim 6, wherein at least one kind of positive ion and at least one kind of negative ion are included in the plurality of target ions.

8. The mass spectrometer according to claim 5, wherein at least one kind of positive ion and at least one kind of negative ion are included in the plurality of target ions.

* * * * *